United States Patent [19]

Sabaté et al.

[11] Patent Number: 4,693,757

[45] Date of Patent: Sep. 15, 1987

[54] PARTICULAR METHOD FOR TREATING ARTICLES MADE OF CORK

[76] Inventors: Modeste Sabaté, Rue Clémenceau, 66160 Le Boulou; Joël Massé, 17 rue Aristide Maillol, 66410 Villelongue de la Salanque, both of France

[21] Appl. No.: 703,177

[22] Filed: Feb. 19, 1985

[30] Foreign Application Priority Data

Dec. 19, 1984 [FR] France ..... 84 19448

[51] Int. Cl.[4] ..... B08B 3/04

[52] U.S. Cl. ..... 134/27; 134/29; 134/33; 422/28

[58] Field of Search ..... 134/25.1, 25.2, 25.3, 134/25.4, 27, 29, 33; 162/91, 99; 252/94, 103; 422/28

[56] References Cited

U.S. PATENT DOCUMENTS 2,155,923 4/1939 Armstrong ..... 134/29
3,922,397 11/1975 Baymiller ..... 427/254

FOREIGN PATENT DOCUMENTS 907518 10/1944 France .

OTHER PUBLICATIONS

Hutchins et al., 1982, Treating a Material to Alter its Surface Appearance, Chemical Abstracts, 100:70197b.
Frazier, 1967, Food Microbiology, McGraw-Hill Book Co., New York, pp. 132–137.
Anderson et al., 1970, Hawthorn Books Inc., New York, The Art of Making Wine, pp. 131–133.

*Primary Examiner*—Raymond N. Jones
*Assistant Examiner*—Carolyn Paden
*Attorney, Agent, or Firm*—Browdy and Neimark

[57] ABSTRACT

The particular method for treating cork articles such as cork plugs, comprises the steps of submitting the cork products to two successive washing operations in a basic aqueous solution, then in a concentrated peroxide solution. Thereafter the cork products are dried with a possible centrifugation.

13 Claims, No Drawings

PARTICULAR METHOD FOR TREATING ARTICLES MADE OF CORK

FIELD OF THE INVENTION

The present invention relates to a particular method for treating articles made of cork.

INFORMATION DISCLOSURE STATEMENT

French Pat. No. 907 518 has described a method for treating articles made of cork and in particular cork plugs, which is characterized by a first washing step made in a chlorinated solution (hypochlorite+calcium chloride) followed by a second washing step in a oxalic acid solution to which may be added coloring materials.

This known method has particularly the drawback to possibly cause a formation of chlorinated organic derivatives in the cork material, and leads moreover to articles which do not have always the desired quality.

Actually, when the above method is applied to cork plugs, the chlorinated organic derivatives can give to the food liquid not only a bad taste (caused by trichloroanisol, which is responsible for the taste of corked wines) but can even produce some compounds dangerous for health.

It is besides most probable that new safety regulations will prevent the use of chlorinated products for treating cork plugs such as for the corking of wine bottles.

The present invention copes with the above mentioned drawbacks by creating a particular method for treating cork products such as cork plugs. The present invention enables further to considerably improve tightness either through the cork material or between the cork material and walls of the containers which are used.

SUMMARY OF THE INVENTION

According to the invention, the cork products are submitted to two successive washing steps in a basic aqueous solution, followed rapidly by a washing step in a concentrated peroxide solution, or in any mixture or combinaison of these two solutions, in order to obtain a decoloration, a delignification and a disinfection of these cork products and, lastly the cork products are air-dried at ambient temperature or at warm temperature.

Various other features of the invention will moreover be revealed from the following detailed disclosure.

DESCRIPTION OF THE PREFERRED EMBODIMENT

The treatment according to the invention employs chemical products which do not leave any undesired products in the cork material, and the efficacity of which is such that there is obtained products the coloration and overall quality of which are substantially improved with respect to those treated by known methods. Lignin which is an undesired product is substantially eliminated; hydrogen peroxide, which is particularly used for its antimicrobial and sporicidal properties, does not leave any residue. Therefore, the standardization of finished articles is greater and better satisfies the international market demand.

The method of the invention comprises, in its preferred embodiment, three steps which can however be reduced to two steps.

The first step comprises a rapid washing operation of cork articles such as cork plugs in a basic aqueous solution (there is used an organic, inorganic or carbonated base), the concentration of which in chemical product can vary and depends on the quality of the cork material and of the magnitude of the reaction which is desired.

Therefore, in this first step of the treatment the base concentrations are comprised between 5 and 200 grams per liter, preferably from 20 to 40 grams per liter of solution.

The second step of the method comprises a second washing operation with a basic solution which is more diluted than the first solution, and the base concentration of which is comprised between 0.5 and 20 grams per liter, preferably 1 and 5 grams per liter and most preferably 2–4 grams per liter. This second washing operation eliminates a great part of the lignin which was degraded by the first washing operation.

The third step of the method uses a peroxide preparation and comprises a rapid dipping of the washed articles in a peroxide solution (either organic or inorganic) and preferably a hydrogen peroxide solution. Concentration of the aqueous solution in peroxide can vary from 20 to 400 grams per liter, but preferably there is used hydrogen peroxide at 80–130 volumes, therefore a concentrated peroxide solution.

The cork articles which have been treated as stated above can then be submitted, in order to dry them, to a centrifugation operation followed by an air drying operation at ambient air or in a warm air stream.

The hereinabove described treatment gives cork plugs or in general cork articles which are decolord, delignified, disinfected and uniformised even with respect to structural defects of the cork material.

There is given hereinafter some examples of the method.

EXAMPLE 1

10,000 cork plugs are washed during thirty seconds in a solution of sodium hydroxide at 40 grams per liter.

The cork plugs are then drained during half-an-hour, then dipped during about thirty seconds in a diluted solution of the same base at a concentration of 4 grams per liter. The resultant washing solution is very dark and rich in lignin degradation products.

The second washing operation is followed by a third washing operation with an hydrogen peroxide solution at 100 volumes during a few seconds. The cork plugs are then drained and dried at the ambient air or at a warm air up to desired dryness.

The plugs which are obtained have a very clear color and the strains or ligneous parts are very reduced or even are disappeared. Disinfection of the cork plugs is very good. They can be submitted to any convenient ulterior treatments such as coloration and staining.

EXAMPLE 2

10,000 cork plugs are washed during one minute in a ammonia solution at 5%, drained thirty minutes and then dipped in a new solution of the same base or of another base at 0.5% during one minute also. The cork plugs are then washed with a solution of hydrogen peroxide at 80 volumes during a few seconds; they are then centrifuged during two minutes, then air dried in ambient air up to dryness. The coloration of the cork plugs is clear and homogeneous.

We claim:

1. A method for treating cork plug articles comprising the steps of:

washing the cork plug articles in a first washing medium comprising a basic aqueous solution at a first concentration between 5 and 200 g/l for a time sufficient to effect degradation of lignin in said cork plug articles;

washing the basic solution treated cork plug articles in a second washing medium comprising a basic aqueous solution at a second concentration between 0.5 and 20 g/l, said second concentration being lower than said first concentration, for a time sufficient to eliminate a substantial part of the lignin degraded in the first washing medium;

treating the second washed cork plug articles in a third medium comprising a concentrated peroxide solution having a third concentration between 20 and 400 g/l, said third concentration being higher than the first concentration, for a time sufficient to achieve disinfection of the cork plug articles after drying thereof; and drying the cork plug articles.

2. A method according to claim 1, wherein the first and second washings are each made during a time interval of about 0.5–1 minute, and wherein the cork plug articles are drained for about half an hour between said first and second washings.

3. A method as set forth in claim 1, wherein the drying step is made together with a centrifugation step.

4. A method as set forth in claim 1, wherein each said aqueous solution contains an organic base, an inorganic base or a carbonate.

5. A method as set forth in claim 1, wherein the first concentration is between 20 and 40 grams per liter.

6. A method as set forth in claim 1, wherein the second concentration is between 1 and 5 grams per liter.

7. A method as set forth in claim 1, wherein the second concentration is between 2 and 4 grams per liter.

8. A method as set forth in claim 5, wherein the third concentration is between 80 and 130 grams per liter.

9. A method as set forth in claim 1, wherein the third treatment is made in a few seconds.

10. A method as set forth in claim 1, wherein the peroxide solution is an hydrogen peroxide solution at 80–130 volumes.

11. A method as set forth in claim 1, comprising the further step of water rinsing the cork plug articles after each of said first and second washings.

12. A method as set forth in claim 8, wherein the second concentration is between 1 and 5 grams per liter.

13. A method of treating cork plug articles comprising the steps of:

washing the cork plug articles in a first washing medium comprising a basic aqueous solution at a first concentration between 5 and 200 g/l;

washing the basic solution treated cork plug articles in a second washing medium comprising a basic aqueous solution at a second concentration between 0.5 and 20 g/l, said second concentration being lower than said first concentration;

treating the second washed cork plug articles in a third medium comprising a concentrated peroxide solution having a third concentration between 20 and 400 g/l, said third concentration being higher than the first concentration;

said washings in said first washing medium and in said second washing medium and said treatment in said third medium being for a time sufficient to obtain decoloration, delignification and disinfection of the cork plug articles after drying thereof; and drying the cork plug articles subsequent to said treating in said third medium.

* * * * *